US005602518A

United States Patent [19]

Clifford, Jr. et al.

[11] Patent Number: 5,602,518

[45] Date of Patent: Feb. 11, 1997

[54] CERAMIC FILTER WITH CHANNELED FEATURES TO CONTROL MAGNETIC COUPLING

[75] Inventors: David G. Clifford, Jr.; Brian C. Walker, both of Albuquerque, N.M.

[73] Assignee: Motorola, Inc., Schaumburg, Ill.

[21] Appl. No.: 410,024

[22] Filed: Mar. 24, 1995

[51] Int. Cl.[6] ..... H01P 1/205

[52] U.S. Cl. ..... 333/202; 333/222; 333/206

[58] Field of Search ..... 333/202, 203, 333/206, 207, 222, 223, 235

[56] References Cited

U.S. PATENT DOCUMENTS

| | | | |
|---|---|---|---|
| 4,806,889 | 2/1989 | Nakano et al. | 333/202 |
| 5,327,109 | 7/1994 | Hoang et al. | 333/206 |

FOREIGN PATENT DOCUMENTS

| | | |
|---|---|---|
| 81501 | 3/1990 | Japan . |
| 165602 | 7/1991 | Japan . |
| 302503 | 10/1992 | Japan . |
| 6109 | 1/1994 | Japan . |
| 53707 | 2/1994 | Japan . |

*Primary Examiner*—Benny Lee
*Assistant Examiner*—David H. Vu
*Attorney, Agent, or Firm*—Gary J. Cunningham

[57] ABSTRACT

A ceramic filter (120) with at least one transmission zero is disclosed. The filter (120) has a filter body comprising a block of dielectric material and having top (110), bottom (112), and side surfaces, and having metallized through-holes extending from the top to the bottom surfaces defining resonators. The surfaces are substantially covered with a conductive material defining a metallized layer. The top surface (110) is uncoated. The filter (120) can also include input-output pads ( 104, 106). The bottom surface (112) has a channel (108) defining a magnetic coupling between the resonators. The channel configuration and placement can vary depending on the desired frequency response.

20 Claims, 5 Drawing Sheets

CERAMIC FILTER WITH CHANNELED FEATURES TO CONTROL MAGNETIC COUPLING

FIELD OF THE INVENTION

This invention relates to ceramic block filters, and particularly to ceramic filters with channeled features to control magnetic coupling.

BACKGROUND OF THE INVENTION

The design and use of filter circuitry for filtering a signal of undesired frequency is well known. It is also known that these filters can be fabricated from ceramic materials having one or more resonators formed therein.

Many conventional ceramic block filters are comprised of parallelepiped shaped blocks of dielectric material through which many holes extend from one surface to the opposite surface. Often, these filters use printed capacitors on the top surface to obtain the desired frequency characteristics of the filter. Another method used to control the frequency characteristic of the filter involves removing ceramic material from one or more surfaces of the block to form embedded features in the ceramic block filter.

Removing material from the surface of the block can lead to a variety of problems during the processing of the ceramic block filter. For example, during the forming stage, embedded features must be capable of being pressed. During firing, the embedded features must not cause the filter to slump or crack. During a post-firing metallization operation, the embedded features must be capable of being easily coated with a viscous material.

It would be considered an improvement in the art to provide a channeled filter which has embedded features on one surface of the ceramic block and that provided an improved frequency response in the form of a high side, low side, or split transmission zero.

DETAILED DESCRIPTION OF THE PREFERRED EMBODIMENT

Figure 1:
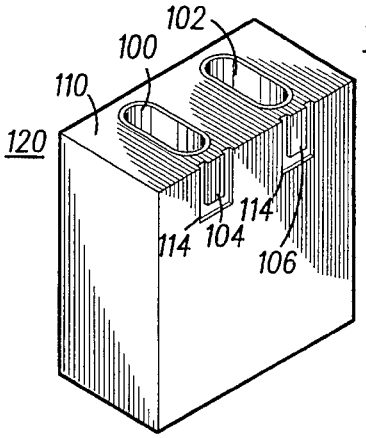
FIG. 1 shows an isometric view of a two-pole ceramic block filter with elliptical resonators, in accordance with the present invention.

FIG. 1 shows one embodiment of a two-pole ceramic block filter 120 with elliptically shaped resonators (through-holes) 100 and 102 which extend from a top surface 110 to a bottom surface 112, or length of the filter 120. The filter has two input-output pads 104 and 106. With the exception of the top surface 110 of the ceramic block through which two included through holes extend, and with the further exception of a portion of one side surface of the block surrounding the input-output pads 114, all external surfaces of the block filter, including surfaces of the block within the through holes, are coated with a conductive material. The conductively coated or metallized external surfaces of the block and the metallized internal surfaces of the through holes, which have a predetermined length, form transmission lines shorted at one end (bottom).

Figure 2:
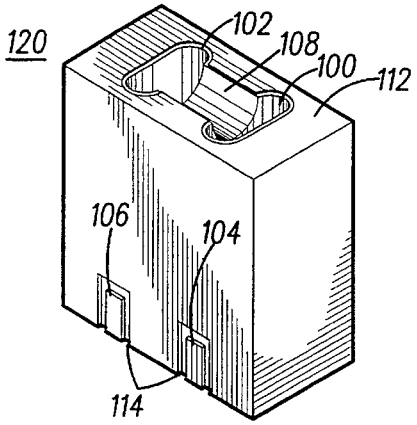
FIG. 2 shows an isometric view of the bottom of the ceramic block filter of FIG. 1 with a channel therein, in accordance with the present invention.
Figure 3:
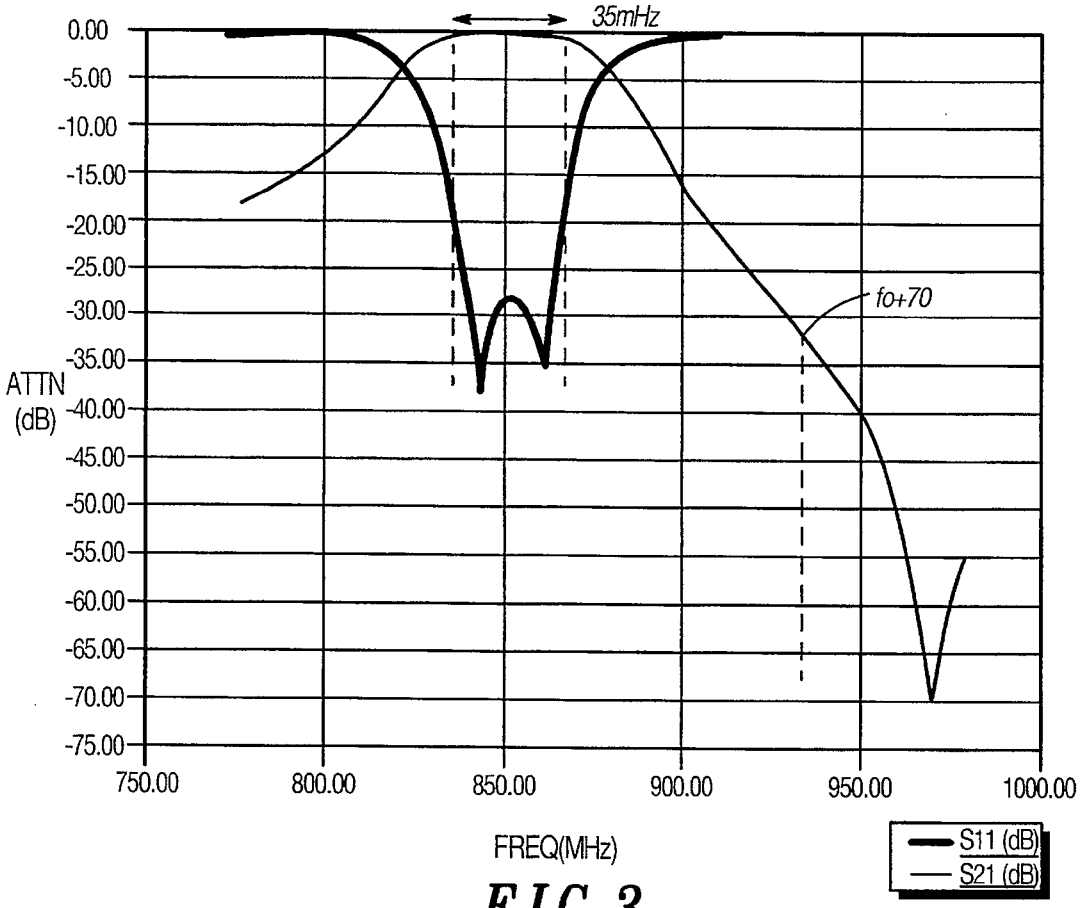
FIG. 3 shows a graph of the improved frequency response in the form of a high side transmission zero for the ceramic block filter shown in FIGS. 1 and 2, in accordance with the present invention.

A channel (or embedded feature) 108 on the bottom surface 112 of the ceramic block 120 is shown in FIG. 2. The purpose of this channel is to effectively increase the magnetic field coupling between the resonators 100 and 102. This has the effect of creating a frequency response curve with a high side transmission zero and a wide passband, as best shown in FIG. 3. This high side zero with a wide passband is achieved by creating embedded features at only one end, namely the bottom end 112, of the block.

Creating embedded features on only the bottom surface 112 of the block has many significant implications. The manufacturing process is improved because these blocks with fewer features have both lower die and tooling costs and reduced wear due to the simple design of the tooling. This can result in an ultimate savings in both time and expense.

The channel 108 feature on the bottom (grounded) surface 112 of the ceramic block filter 120 provides an improved frequency response. In one embodiment, the channel 108 includes a substantially smooth and substantially rounded surface adapted to receive metallization. Thus another advantage of the present design is that it is easily metallized using conventional coating processes. Since every channel in every embodiment will be coated with a conductive material, this is an important feature of this ceramic block filter.

In one embodiment, the channel 108 has a radius of curvature substantially within about ten percent or less that of one of the through holes 100 or 102. This can lead to a simple design which is easy to manufacture and metallize. Other embodiments may be designed such that the channel has a radius of curvature substantially equal to that of one of the through-holes. In any event, the radius of curvature of the channel 108 is another design variable which can be controlled to achieve optimal properties from the filter.

Another important feature of the channel 108 in the ceramic block filter is the depth of the channel. The channel should have a depth which is sufficiently deep to provide a predetermined magnetic coupling and is sufficiently shallow to maintain a desired structural integrity. In one embodiment, the channel 108 will have a depth of less than about thirty-three percent of the height of the filter body which is defined as the distance from the top to the bottom surface of the block, and preferably about twenty percent for a desired frequency response. Thus, for a filter having a height of about 300 mils, the depth of the channel will be about 50 mils. Of course, other embodiments may use the depth of the channel as a design consideration and may vary both the depth of the channel as well as its radius of curvature in order to optimize the frequency response characteristics of the filter. However, in order to facilitate the manufacture of the block, the channel depth will usually be about one third or less of the height of the block (which is defined as the distance from the top to the bottom surface of the block).

In more detail, the channel depth will have a direct effect on the resultant bandwidth of the ceramic block filter. As the depth of the channel increases, the transmission zero will typically move away from the center frequency. Thus, the depth of the channel can be used as a design variable to control the ultimate frequency response curve of the filter.

The surface area of the channel 108 on the bottom surface of the block 112 is another important parameter. In a preferred embodiment, the channel 108 will include an area which is about fifty percent or less of the total surface area of the bottom surface 112 of the block. This is necessary to maintain structural integrity. If the channel area were greater, the wall thickness of the ceramic block filter 120 surrounding the channel would become thin to the point of being prohibitive from a manufacturing standpoint.

FIG. 3 shows a graph of the improved frequency response curve in the form of a high side transmission zero and a wide passband. In the embodiment shown in FIGS. 1 and 2, the resonators 100 and 102 are elliptically shaped so that the distance from the resonator to its corresponding input-output pad is effectively reduced resulting in greater electrical coupling to the input-output pads 104 and 106 on the side surface of the block 110. By forming elliptically shaped resonator holes 100 and 102, the coupling between adjacent resonator holes is increased, resulting in a wider passband. This may be desirable for certain filter applications. In other embodiments, the resonators may be either circularly shaped or may take other shapes to facilitate the design of the block filter 120.

Figure 4:
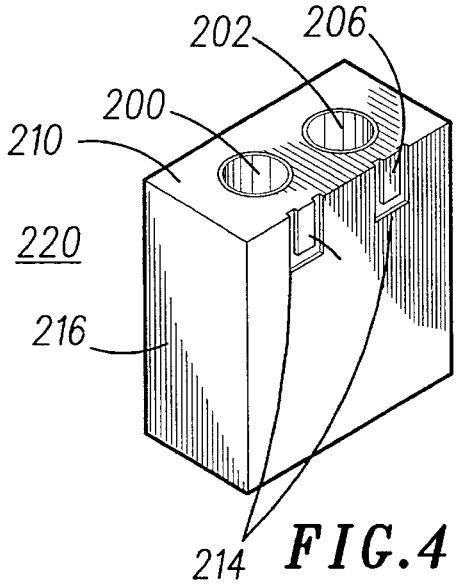
FIG. 4 shows an isometric view of a two-pole ceramic block filter with circular resonators, in accordance with the present invention.

Another embodiment of a two-pole ceramic block filter is shown in FIG. 4. This ceramic block filter 220 has two circularly shaped resonators (through-holes) 200 and 202 which run from the top surface 210 to the bottom surface 212 of the ceramic block filter 220. The filter also has two input-output pads 204 and 206 which are surrounded by unmetallized areas 214. Most external surfaces of the block filter, including surfaces of the block within the through holes, are coated with a conductive material. However, the top surface 210 and a portion of one side surface of the block surrounding the input-output pads are not covered with a conductive coating. The conductively coated or metallized external surfaces of the block and the metallized internal surfaces of the through holes, which have a predetermined length, form transmission lines shorted at one end (bottom).

Figure 5:
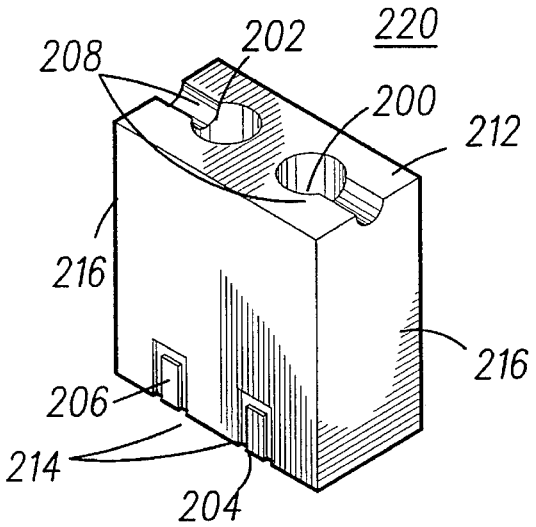
FIG. 5 shows an isometric view of the bottom of the ceramic block filter of FIG. 4 with outwardly extending channels therein, in accordance with the present invention.

The bottom surface 212 of this ceramic block filter 210 is shown in FIG. 5. From this view, two channels 208 (embedded features) can be seen which extend outwardly toward the side surfaces 216 of the ceramic block filter 220, hereinafter referred to as the outer channels. With respect to the channel depth and radius of curvature and surface area on the bottom of the block 212, these outer channels have substantially similar features as the channel described in connection with FIGS. 1–3.

In the embodiment in FIGS. 3–6, however, the effect of these channels are opposite to the channel shown in FIG. 2. In this embodiment, the purpose of the channels 208 is to effectively decrease the magnetic field coupling between the resonators 200 and 202. This has the effect of creating a frequency response curve with a low side transmission zero and a wide passband. It is important to note that this low side transmission zero with a wide passband is achieved by creating embedded features 208 on only one end, namely the bottom surface 212 of the block.

In a preferred embodiment, the outer channels 208 extend substantially though the side surfaces 216 of the ceramic block filter 220. When the outer channels 208 extend completely through to the outer surfaces 216 of the block, this results in a block that is free from thin walls. Consequently, the block is easier to manufacture and metallize. In particular, the design of the tooling to press the block in this manner will not leave an edge which requires deburring as a post pressing operation. Furthermore, a design in which the outer channels 208 extend completely through the outer wall minimizes the possibility that certain features of the block will break off during the pressing or firing operation, for example. Other embodiments of this invention may, however, maintain a wall of variable thickness between the outer channels 208 and the side surfaces 216 of the block.

The outer channels 208 may also be sloped to facilitate application of the conductive coating and to avoid pooling of the conductive coating material. In a preferred embodiment, the outer channels 208 may be tapered to an angle of about sixty degrees or less with respect to a horizontal axis. An alternative embodiment could encompass a taper which would exist within the channel itself. In other words, the tooling could be designed such that a channel that joins two consecutive resonators would be elevated in its central portion such that one half of the length of each channel tapers in the direction of its corresponding resonator hole.

Although the direction of the taper is such that the conductive coating material should flow down into the resonator holes, other embodiments may be tapered such that the conductive material flows the other way toward the side surface of the block as design considerations dictate.

Figure 6:
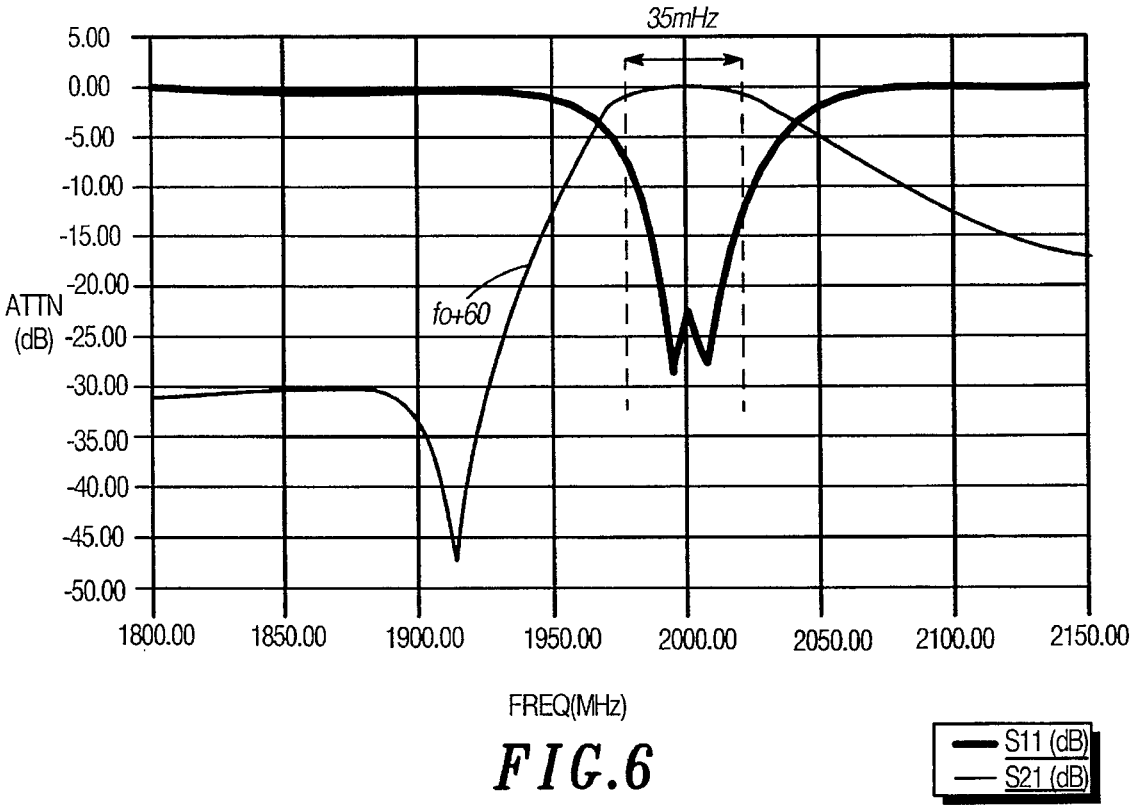
FIG. 6 shows a graph of the improved frequency response in the form of a low side transmission zero for the ceramic block filter shown in FIGS. 4 and 5, in accordance with the present invention.

FIG. 6 shows a graph of the improved frequency response in the form of a low side transmission zero and a wide passband for the ceramic block filter shown if FIGS. 4 and 5. Note that this precise frequency response profile can be altered by changing one or more of the design parameters detailed above.

Figure 7:
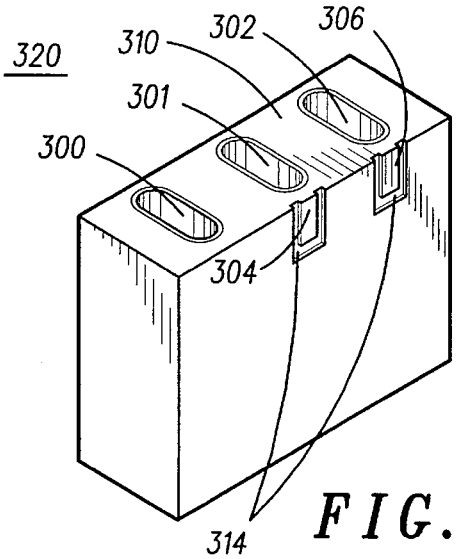
FIG. 7 shows an isometric view of a three-pole ceramic block filter with elliptical resonators, in accordance with the present invention.
Figure 8:
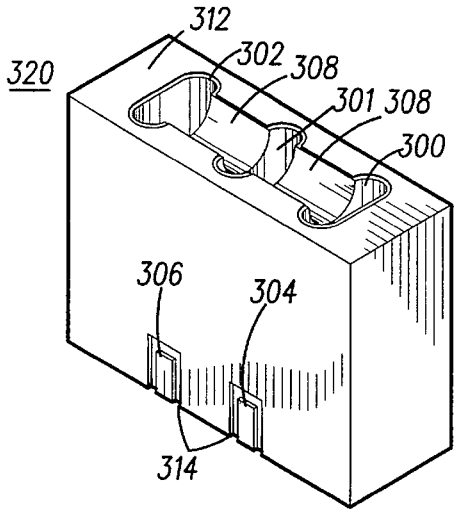
FIG. 8 shows an isometric view of the bottom of the ceramic block filter of FIG. 7 with two channels therein, in accordance with the present invention.

FIGS. 7 and 8 show a three pole ceramic block filter 320. This filter 320 has three elliptically shaped resonators 300, 301 and 302 and two input-output pads 304 and 306 which are surrounded by unmetallized areas 314. All other surfaces of the block are metallized except for the top surface 310. The channels 308 of filter 320 are on the bottom surface 312 of the block and extend substantially between the resonators 300, 301 and 302, creating a frequency response curve with a high side transmission zero and a wide passband.

As should be understood by those skilled in the art, the present invention could be applied to a filter with four, five, or any number of resonators. The result of the present invention could be achieved by simply channeling between consecutive resonators to adjust the magnetic coupling between the resonators to create a desired frequency response. In other embodiments, channels could be provided only between alternate pairs of resonators. Alternatively, channels could also be provided between the resonators at only one end of the block or any variation thereof.

Figure 9:
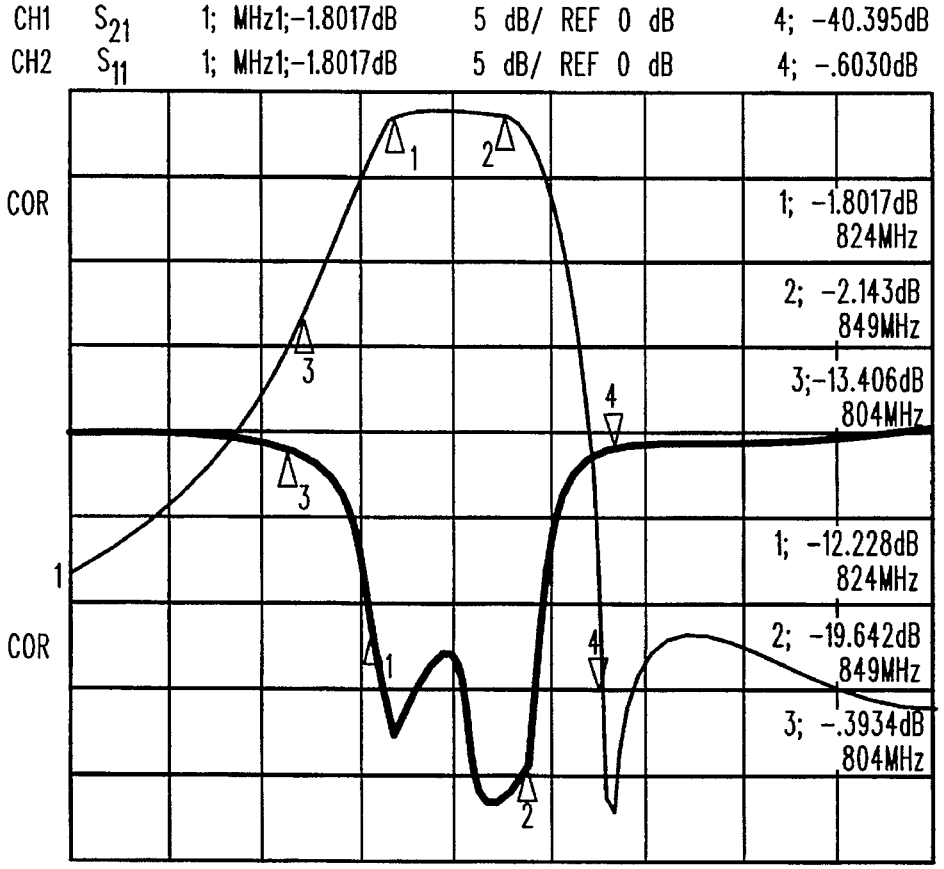
FIG. 9 shows a graph of the improved frequency response in the form of a high side transmission zero for the ceramic block filter shown in FIGS. 7 and 8, in accordance with the present invention.

FIG. 9 shows a graph of the improved frequency response in the form of a high side transmission zero for the ceramic block filter shown in FIGS. 7 and 8. This graph shows a high side zero with a wide passband.

Figure 10:
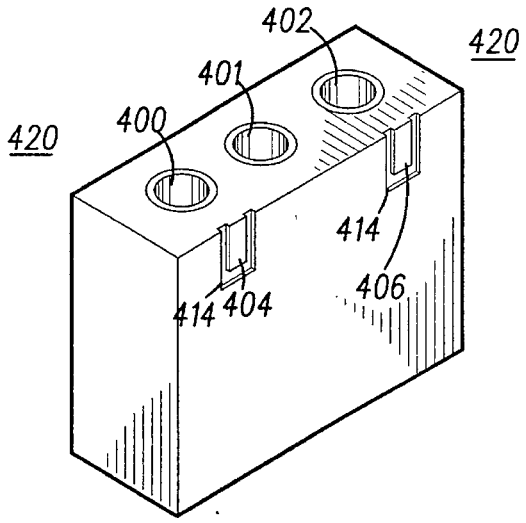
FIG. 10 shows an isometric view of a three-pole ceramic block filter with circular resonators, in accordance with the present invention.
Figure 11:
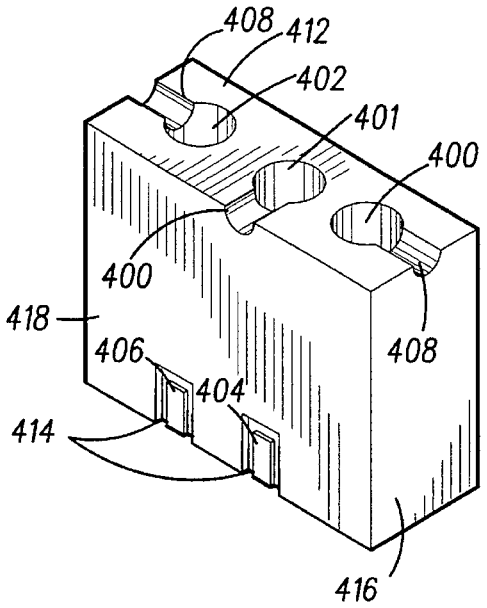
FIG. 11 shows an isometric view of the bottom of the ceramic block shown in FIG. 10 with outwardly extending channels therein, in accordance with the present invention.

FIGS. 10 and 11 show another embodiment of the present invention applied to a three pole ceramic filter 420 with circular resonators. More specifically, filter 420 has three resonators 400, 401 and 402 and two input-output pads 404 and 406 which are surrounded by unmetallized areas 414. All other surfaces of the block are metallized except for the top surface 410. The outer and middle channels 408 in this embodiment are on the bottom surface 412 of the block and extend outwardly to the side and front surfaces 416 and 418, respectively, creating a frequency response curve with a low side transmission zero and a wide passband.

In this embodiment, each channel is designed to seek the shortest distance to electrical ground. For the end resonators 400 and 402, this will be to the (short) side surface 416 of the block. For any other resonators (middle), they will create channels which are perpendicular to the channels created by the end resonators. Although FIG. 11 shows the middle channel in a direction toward the front surface 418 of the block with the input-output pads, other embodiments of the present invention may have the middle channel extend toward the opposite rear surface of the block. In all instances, however, it is preferred that the channels will take the shortest distance from a resonator to ground.

Figure 12:
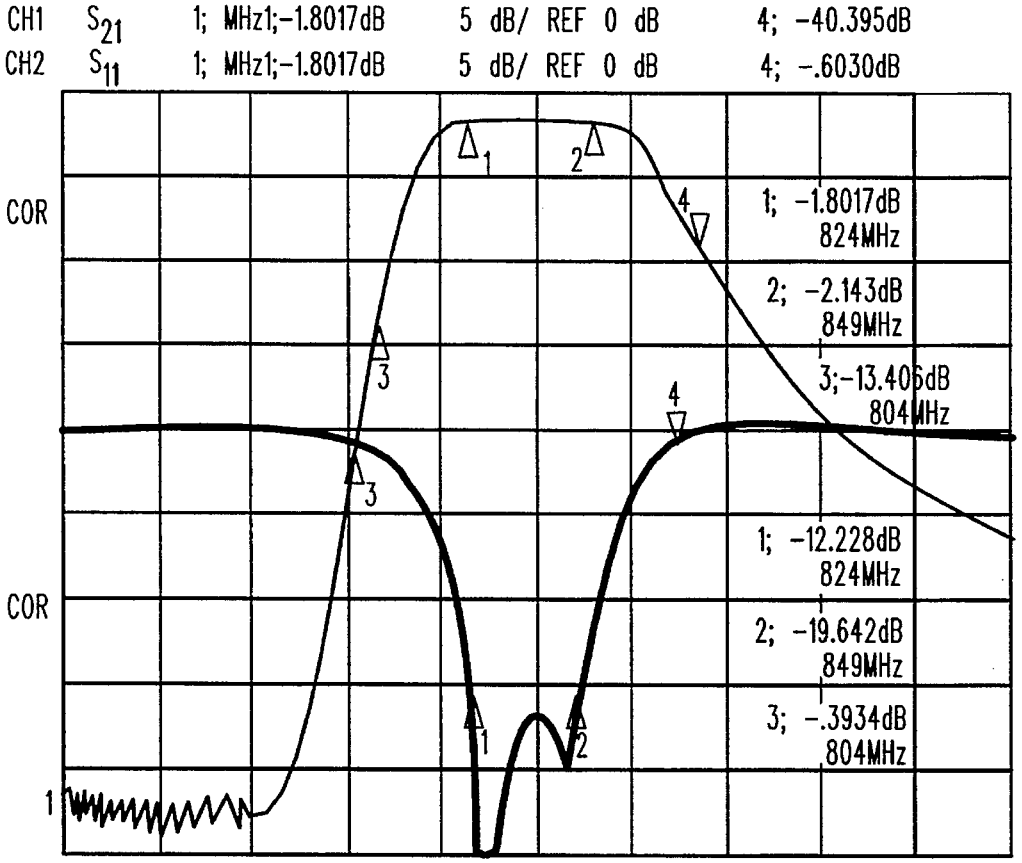
FIG. 12 shows a graph of the improved frequency response in the form of a low-side transmission zero for the ceramic block filter shown in FIGS. 10 and 11, in accordance with the present invention.

FIG. 12 shows a graph of the improved frequency response curve in the form of a low side zero with a wide passband for the ceramic block filter shown in FIGS. 10 and 11. Every embodiment of the present invention in which the channels are properly grounded will have a frequency response curve which is substantially similar to the graph shown in FIG. 12.

Figure 13:
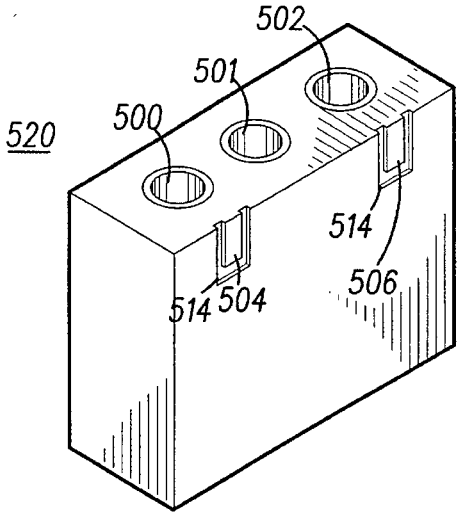
FIG. 13 shows an isometric view of a three-pole ceramic block filter with circular resonators, in accordance with the present invention.
Figure 14:
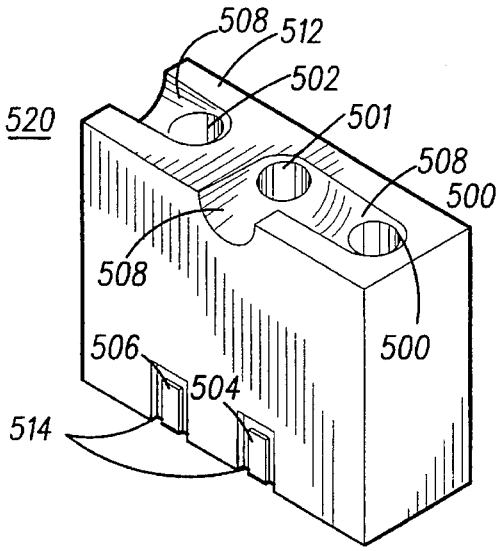
FIG. 14 shows an isometric view of the bottom of the ceramic block filter of FIG. 13 with channels both between the resonators and to the sides of the block, in accordance with the present invention.

Referring to FIGS. 13 and 14, isometric views of a three-pole ceramic block filter 520 with circular resonators are shown. The filter 520 has three resonators (throughholes) 500, 501 and 502 and two input-output pads 504 and 506 which are surrounded by unmetallized areas 514. All other surfaces of the block are metallized except for the top surface 510. In this embodiment, the channels 508 are on the bottom surface 512 of the filter 520.

Figure 15:
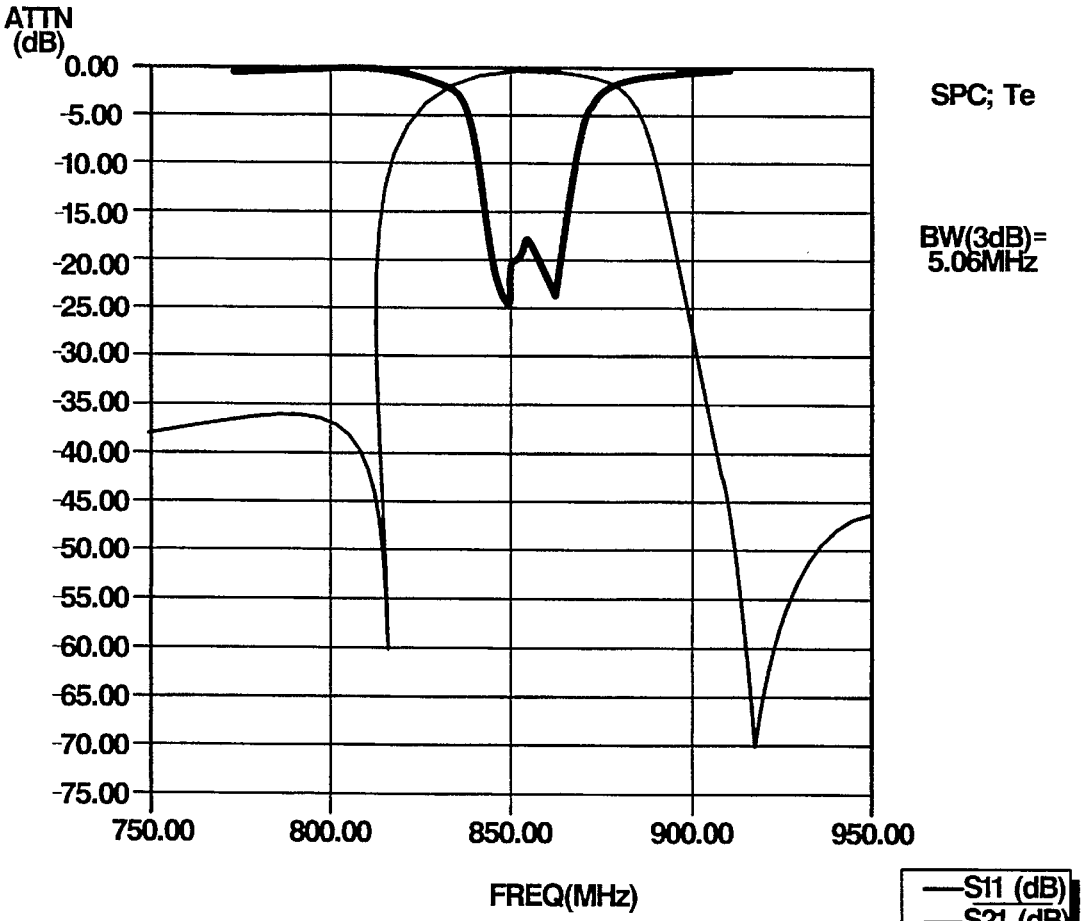
FIG. 15 shows a graph of the improved frequency response in the form of a split-zero for the ceramic filter shown in FIGS. 13 and 14, in accordance with the present invention.

More particularly, the bottom surface 512 has channels 508 between resonators 500, 501 and 502, defining central channels as well as channels from the resonators to adjacent side surfaces defining outer channels. The purpose for having both types of channels on the same ceramic block filter is to create a split zero frequency response curve, substantially as shown in FIG. 15. As should be understood, for a multi-pole filter, a multi-zero response curve can be created. In this embodiment, one transmission zero is below the passband and another transmission zero is above the passband. This may be a desirable configuration for numerous filter designs.

Another advantage of having both central and outer channels on the same block is to desensitize the block to the effect of a movement of the passband which is created when a block filter with only one channel is lapped during processing. Whereas the passband of a block filter with only one channel will move dramatically during a lapping operation procedure, this effect can be reduced by adding another channel which serves to counter-balance the first channel. This is just one of many other design considerations that can mandate the use of both types of channels on the same block.

An important feature of the present invention is the fact that a single filter may have a number of different channels running along the bottom surface of the ceramic block filter. While some channels may extend solely between resonators, other channels, on the same block, may extend outwardly to the side surfaces of the block. As the number of resonators increases, the number of possible variations also increase. As should be understood, various modifications and possible configurations can be made in the course of designing the ceramic block filter and are considered within the teachings of this invention.

Although the present invention has been described with reference to certain preferred embodiments, numerous modifications and variations can be made by those skilled in the art without departing from the novel spirit and scope of this invention.

What is claimed is:

1. A ceramic filter with at least one transmission zero, comprising:

(a) a filter body comprising a block of dielectric material having top, bottom, and side surfaces, and having a plurality of metallized through-holes extending from the top to the bottom surfaces defining resonators, the surfaces being substantially covered with a conductive material defining a metallized layer, with the exception that the top surface is uncoated;

(b) first and second input-output pads comprising an area of conductive material on at least one of the side surfaces and at least immediately surrounded by an unmetallized area; and (c) the bottom surface having at least one metallized channel that extends from one of the resonators to at least one of an adjacent resonator and an adjacent side surface.

2. The filter of claim 1, wherein the channel connects and extends between the resonators, whereby the frequency response has a high side zero and a wide passband.

3. The filter of claim 1, wherein the channel includes a smooth and substantially rounded surface.

4. The filter of claim 1, wherein the channel has a radius of curvature substantially equal to that of one of the through-holes.

5. The filter of claim 1, wherein the channel has a radius of curvature substantially within about ten percent or less of that of one of the through-holes.

6. The filter of claim 1, wherein the channel on the bottom surface extends at least between two adjacent through-holes.

7. The filter of claim 1, wherein the channel is sufficiently deep to provide a predetermined magnetic coupling, the magnetic coupling being defined by the channel depth being about one half or less of a height of the block, the height being defined as the distance from the bottom to the top surfaces.

8. The filter of claim 1, wherein the channel has a depth of less than about twenty percent of the height of the filter body which is defined as the distance from the top to the bottom surface of the block.

9. The filter of claim 1, wherein the channel has a depth of less than about one-third of the height of the block which is defined as the distance from the top to the bottom surface of the block.

10. The filter of claim 1, wherein the channel includes an area which is about fifty percent or less of the total surface area of the bottom surface.

11. The filter of claim 1, wherein the channel on the bottom surface of the block extends outwardly from at least one of the resonators to an adjacent side surface, defining an outer channel with a predetermined magnetic coupling and frequency response.

12. The filter of claim 1, wherein the bottom surface has a channel between the resonators, defining a central channel, and a channel from the resonators to adjacent side surfaces, defining outer channels.

13. A ceramic filter with a transmission zero, comprising:

(a) a filter body comprising a block of dielectric material and having top, bottom, and side surfaces, and having a plurality of metallized through-holes extending from the top to the bottom surfaces defining a metallized layer, with the exception that the top surface is uncoated;

(b) first and second input-output pads comprising an area of conductive material on at least one of the side surfaces and at least immediately surrounded by an unmetallized area of conductive material, and (c) the bottom surface having at least one metallized-outer channel which extends from at least one of the resonators to an adjacent side surface, defining an outer channel with a magnetic coupling, whereby the frequency response has a low side transmission zero and a wide passband.

14. The filter of claim 13, wherein there are two outer channels tapered at an angle of about sixty degrees or less with respect to a horizontal axis.

15. The filter of claim 13, wherein the outer channel extends substantially through the adjacent side surface.

16. The filter of claim 13, wherein the outer channel is substantially rounded and has a radius of curvature substantially equal to that of the through-holes.

17. The filter of claim 13, wherein the outer channel has a radius of curvature substantially within about ten percent or less of that of the through-holes.

18. The filter of claim 13, wherein the outer channel has a depth of less than about twenty percent of the height of the filter body which is defined as the distance from the top to the bottom surface.

19. The filter of claim 13, wherein the outer channels have a depth of less than about one-third of the height of the block which is defined as the distance from the top to the bottom surfaces of the block, for providing a desired magnetic coupling.

20. The filter of claim 13, wherein there are two outer channels having an area which is about fifty percent or less of the total surface area of the bottom surface of the block.

* * * * *